US006595387B1

(12) United States Patent
Zimmermann et al.

(10) Patent No.: US 6,595,387 B1
(45) Date of Patent: Jul. 22, 2003

(54) DISPENSER FOR SHEETS SUCH AS NOTE PAD PAPER

(75) Inventors: Harold M. Zimmermann, Cinnaminson, NJ (US); Michael Waters, Del Ran, NJ (US); Gary Reuther, Warminster, PA (US)

(73) Assignee: Harold M. Zimmerman, Cinnaminson, NJ (US)

( * ) Notice: Subject to any disclaimer, the term of this patent is extended or adjusted under 35 U.S.C. 154(b) by 40 days.

(21) Appl. No.: 10/060,825

(22) Filed: Jan. 28, 2002

(51) Int. Cl.[7] ..... B65G 59/00
(52) U.S. Cl. ..... 221/259; 206/812
(58) Field of Search ..... 221/259, 210, 221/255, 268, 285, 33, 45, 56; 206/812, 494, 559

(56) References Cited

U.S. PATENT DOCUMENTS

| | | | |
|---|---|---|---|
| 3,517,855 | A | 6/1970 | Hillis |
| 4,071,165 | A | 1/1978 | Leopoldi |
| 4,865,223 | A | 9/1989 | Huang |
| 4,907,825 | A | 3/1990 | Miles |
| 4,941,591 | A | 7/1990 | Lin et al. |
| 5,080,254 | A | 1/1992 | Feer |
| 5,104,000 | A | 4/1992 | Goff |
| 5,299,712 | A | 4/1994 | Carlson et al. |
| 5,390,819 | A | 2/1995 | Kaye |
| 5,765,721 | A | 6/1998 | Vance |
| 6,267,263 | B1 | 7/2001 | Emoff et al. |

*Primary Examiner*—Kenneth W. Noland
(74) *Attorney, Agent, or Firm*—Michael Hoffman; The Soni Law Firm

(57) ABSTRACT

An apparatus and method for dispensing individual sheets of stack of adhesive coated sheets is disclosed. The apparatus is comprised of a carriage for receiving the stack of adhesive coated sheets; reciprocating means for intermittently driving the carriage from a first rest position to a second rest position and vice versa; and guiding means for directing the distal edge of a sheet from a guide input to a guide output as the carriage is driven by the reciprocating means from the first rest position to the second rest position or vice versa. The invention is useful for dispensing said sheets without requiring that each sheet be pulled through or drawn out the guide output under the force of the releasable adhesive bond between adjacent sheets. Using the invention, one may cause a sheet to be dispensed to a position where it is accessible to the user only when the sheet is actually needed.

24 Claims, 6 Drawing Sheets

DISPENSER FOR SHEETS SUCH AS NOTE PAD PAPER

BACKGROUND

This present invention relates to a device for dispensing thin sheets including paper. More particularly, the invention relates to a method and apparatus for dispensing individual sheets of adhesive coated products, including note pad papers, from a stack where the sheets releasably adhere to one another along opposite edges of successive sheets.

The prior art includes a number of dispensers for use with sheet and various other stationary products. The vast majority of the devices are designed to receive a uniform stack of identical sheets. The individual sheets are then dispensed by engaging and moving the sheet to a position that is accessible to the user. The means for engaging the sheet is typically a mechanical arm that frictionally engages the sheet and slidably removing it from the remaining sheets of the stack. This same operational mechanism is repeated in a number of patents, namely U.S. Pat. No. 4,071,165 to Leopoldi, U.S. Pat. No. 4,941,591 to Lin et al, U.S. Pat. No. 4,865,223 to Huang, U.S. Pat. No. 5,104,000 to Goff, and U.S. Pat. No. 3,517,855 to Hillis. However, each of these devices is impractical for use with the unbound, adhesive coated sheet products to which the present invention pertains.

U.S. Pat. No. 5,765,721 to Vance discloses a mechanism for dispensing individual sheets of note pad paper having a reusable adhesive strip on each leaf of the note pad. Although the invention is effective for separating an individual sheet from a stack of adhesive coated sheets, it is limited to a specific type of note paper in which the adhesive is applied to a common edge or side of every sheet within the stack. As such, it is inoperable with respect to the type of sheet product the present invention is directed toward.

U.S. Pat. No. 5,080,254 to Feer, U.S. Pat. No. 6,267,263 to Emoff et al., U.S. Pat. No. 4,907,825 to Miles, and U.S. Pat. No. 5,299,712 to Carlson et al. are intended for use with note pad papers that releasably adhere to one another using a thin adhesive strip along opposite edges of successive sheets. An example of an adhesive coated stack is sold under the trade designation "POST-IT" by Minnesota Mining and Manufacturing Company, St. Paul, Minn.

The patents to Feer, Emoff, Miles, and Carlson each disclose an apparatus in which the upper most sheet of the stack of adhesive coated sheets is made to protrude from a slot in the top surface of each container. The edge of the uppermost sheet opposite the adhesive strip is drawn from the container as a consequence of the removal of the previous uppermost sheet. Once an edge is ejected from the slot, the sheet remains in the position that is visible and accessible to the user until it is removed. In each prior art dispenser, the edge of the uppermost sheet must necessarily protrude from the dispenser to permit the user to access the sheet as well as manually draw the next sheet below into the position of the upper most sheet.

SUMMARY

The present invention overcomes the limitations of the prior art with a dispenser that supports the uppermost sheet in proximity to the dispenser's output until the dispenser is actuated, at which point the uppermost sheet is ejected from the dispenser using a mechanism that is independent of the process or means for removing the previous uppermost sheet, as required by the prior art.

In one embodiment of the present invention, the apparatus for dispensing individual sheets from a stack of adhesive coated sheets is comprised of a guide output; guiding means for directing the distal edge of the uppermost sheet out of the guide output; and repositioning means for intermittently altering the relative position of the stack and guiding means. In this embodiment, the distal edge of the uppermost sheet is driven from the position within the guiding means to a position accessible to the user at the guide output when the relative reposition of the stack and guiding means are changed by the repositioning means. The guiding means may take any of a number of forms including a pair of substantially planar structures that converge in the direction of the dispenser's guide output. The repositioning means may include, for example, an electro-mechanical or other power operated device for altering the relative positions of the stack and guiding means. One skilled in the art will recognize that repositioning means may operate by moving the stack relative to the guiding means or, in the alternative, by moving the guide means relative to the stack.

In another embodiment, the dispenser is comprised of a carriage for retaining the stack of adhesive coated sheets; guiding means for laterally supporting the distal edge of a sheet and for directing the distal edge of the sheet out of the guiding means; and reciprocating means for intermittently altering the relative position of the carriage and guiding means. The distal edge of the sheet being laterally supported by the guiding means is directed out of the guiding means as the relative position of the carriage and guiding means are altered by the reciprocating means. The reciprocating means may actuate the carriage, the guide means, or both in response to the user input.

In another embodiment of the invention, the dispenser is comprised of a carriage in which the stack of adhesive coated sheets sits; reciprocating means for intermittently driving the carriage from a first rest position to a second rest position and vice versa; and guiding means having a guide input and guide output for directing the distal edge of a sheet from the guide input to the guide output as the carriage is driven by the reciprocating means from the first rest position to the second rest position or vice versa.

The method of dispensing sheets from a stack of adhesive coated sheets located at a first rest position, is comprised of the steps of positioning the distal end of an uppermost sheet against a first guide of a guiding means; repositioning the stack of adhesive coated sheets to a second rest position such that the distal end of an uppermost sheet is dispensed from the a guide output of the guiding means where it is accessible to the dispenser's user; positioning the distal end of the next most sheet, i.e. the sheet immediately below the uppermost sheet, against a second guide of the guiding means; and repositioning the stack of adhesive coated sheets to the first rest position such that the distal end of an next most sheet is dispensed or ejected from the guide output where it is accessible to the dispenser's user.

DETAILED DESCRIPTION

The invention pertains to a dispenser for dispensing individual sheets of a variety of materials from a stack of adhesive coated sheets. The preferred form of stack includes a plurality of substantially rectangular paper sheets of paper, for example, that have a strip of adhesive that releasably attaches an uppermost sheet to the adjacent lower sheet in the stack. The strip of adhesive is applied on the underside of a given sheet along one side or edge, this edge being referred to as the proximal edge. The distal edge, then opposite the proximal edge, does not include any adhesive although it may be releasably attached to a strip of adhesive applied to the sheet immediately above. Thus, the distal edge of any given upper sheet will correspond to the proximal edge of the adjacent lower sheet.

Adhesive coated sheets as described above may be assembled to form a stack of adhesive coated sheets where the sheets releasably adhere to one another along opposite edges of successive sheets. This stack of adhesive coated sheets is such that the adhesive edge alternates between opposing sides from sheet to sheet in a style that resemble an accordion when drawn apart from one another. As will be seen below, the reciprocating mechanism of the present invention is ideally suited for dispensing a single sheet from such a stack of adhesive coated sheets. With appropriate modification, the dispenser can be designed to dispense papers of various sizes, including 3 inch square and 3 by 5 inch, 2⅝ by 2⅞ inch, 1½ by 2 inch, 3 by 4 inch, 3 by 3⁵⁄₁₆ inch, 1 by 3 inch, 2 by 3 inch 1 by 1¾ inch, or sheets of different adhesive configurations, including that described in U.S. Pat. No. 5,390,819 to Kaye, herein incorporated by reference.

Figure 1:
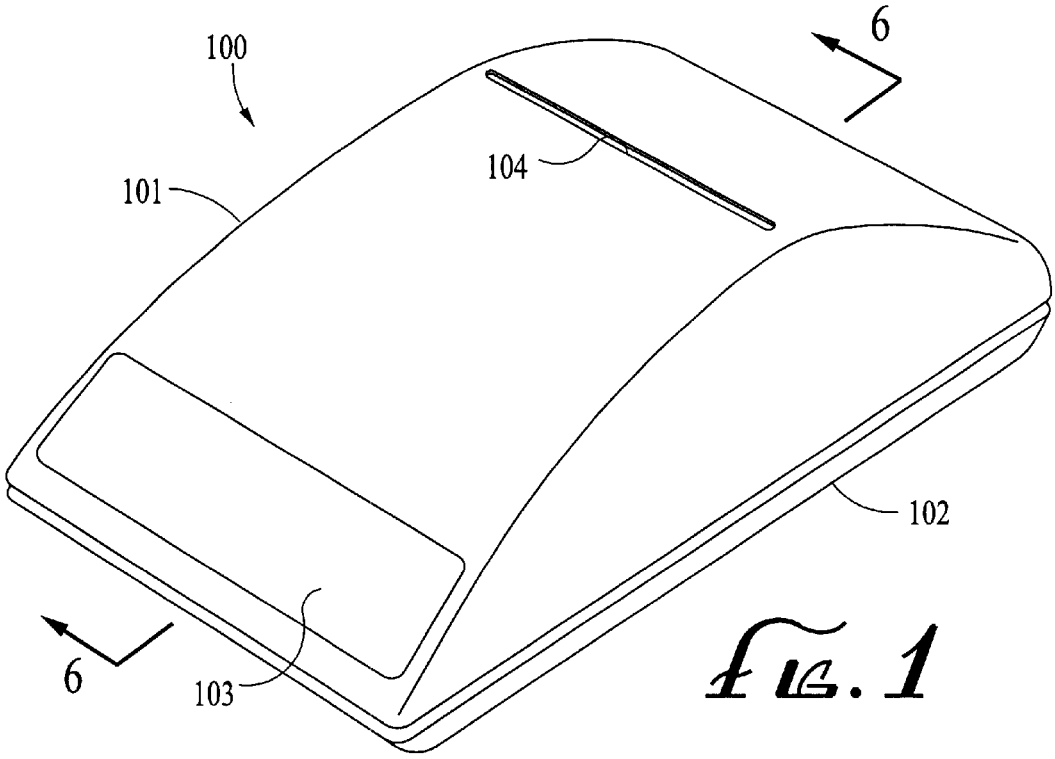
FIG. 1 is a perspective view illustrating the exterior of the top, front and side of the preferred embodiment of the present invention.

Referring to FIG. 1, a perspective view of the exterior of the preferred embodiment is illustrated looking on from the top, front and side. The dispenser 100 is preferably comprised of a lid 101 and a base 102 that frictionally engage one another. The lid structure 101 of the preferred embodiment includes a push bar 103, which causes a single sheet to be dispensed from the slot or guide output 104.

Figure 2:
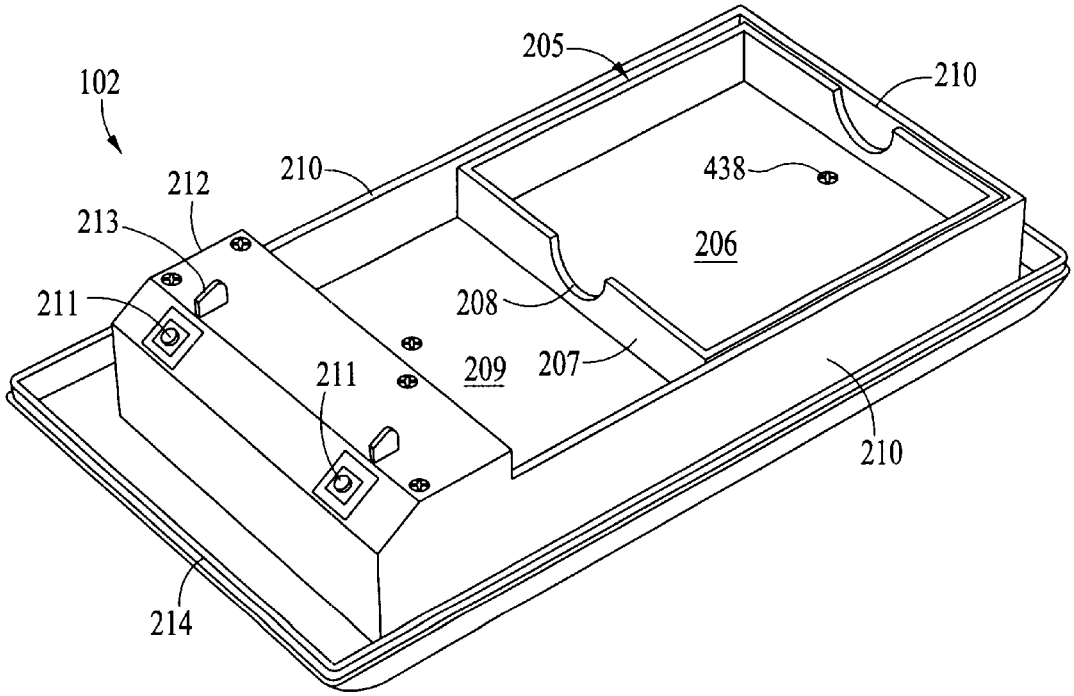
FIG. 2 is a perspective view of the internal side of the base structure illustrating in part the carriage and housing according to the preferred embodiment.

Referring to FIG. 2, a perspective view of the internal side of the base 102 illustrating the carriage and housing according to the preferred embodiment. The exterior of the internal housing 212 is comprised of one or more push button switches 211 that are engaged when the push bar 103 is depressed. The interior of the housing 212 of the preferred embodiment includes various electrical components including the reciprocating means discussed below and one or more batteries for use with portable or desk-top dispenser units.

The carriage 205 receives a stack of adhesive coated sheets (not shown) which is held in position by the carriage walls 207. The carriage 205 of the preferred embodiment includes a plurality of wheels (not shown) that are supported from underneath by the support 209. One skilled in the art will recognize a number of alternative configurations, including rails, rollers and bearing, suitable for permitting relative movement of the carriage with respect to the cooperating structures including the guiding means discussed below. The carriage 205 is driven by the reciprocating means mounted in part within the housing 212, preferably. The movement of the carriage 205 is confined to oscillate within a region defined by the flange 210 and the housing 212 in the preferred embodiment.

In the preferred embodiment, the reciprocating means drives the carriage 205 and the stack therein between two rest positions corresponding to the maximum displacement of the carriage 205 through its oscillatory cycle. The carriage 205 illustrated in FIG. 2 is shown at a first rest position corresponding to the maximum throw of the reciprocating means. The carriage 205 sits idle in this first rest position until a user causes the reciprocating means to drive, i.e. to reposition, the carriage 205 to a second rest position which, in the preferred embodiment, is adjacent to the housing 212. The path traced as the carriage 205 oscillates between the first and second rest positions approximately coinciding with the perimeter defined by the flange 210 and the housing 212.

Figure 3A:
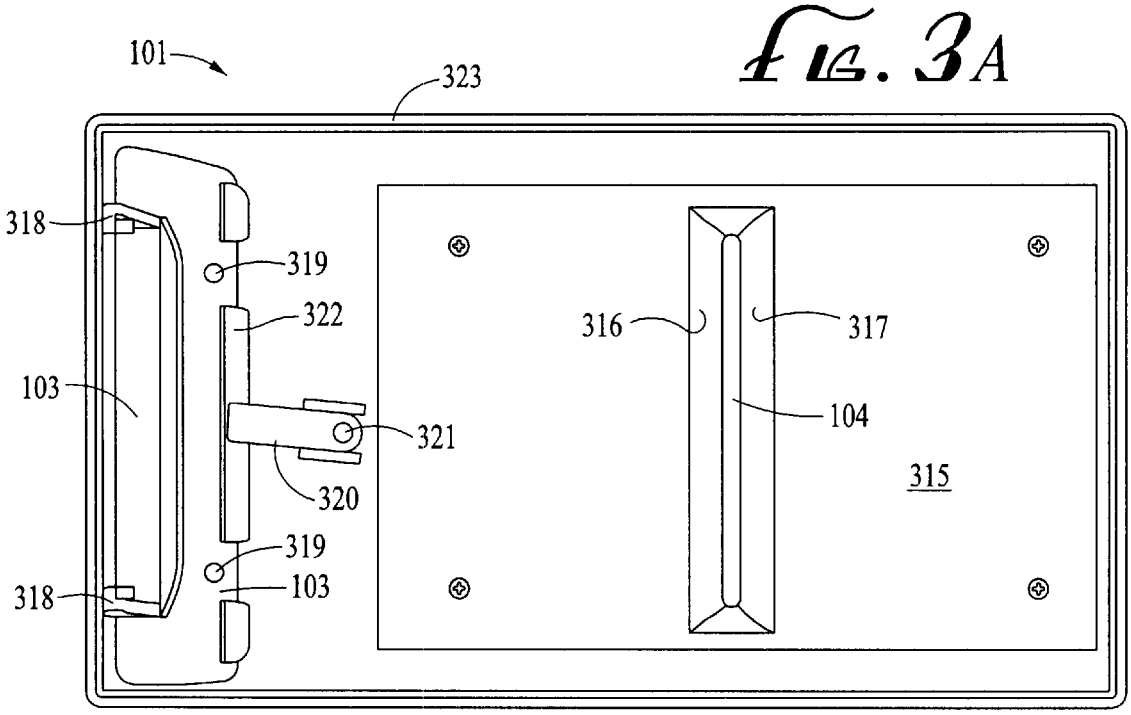
FIG. 3*a* is a plan view of the internal side of the lid structure of the preferred embodiment.
Figure 3B:
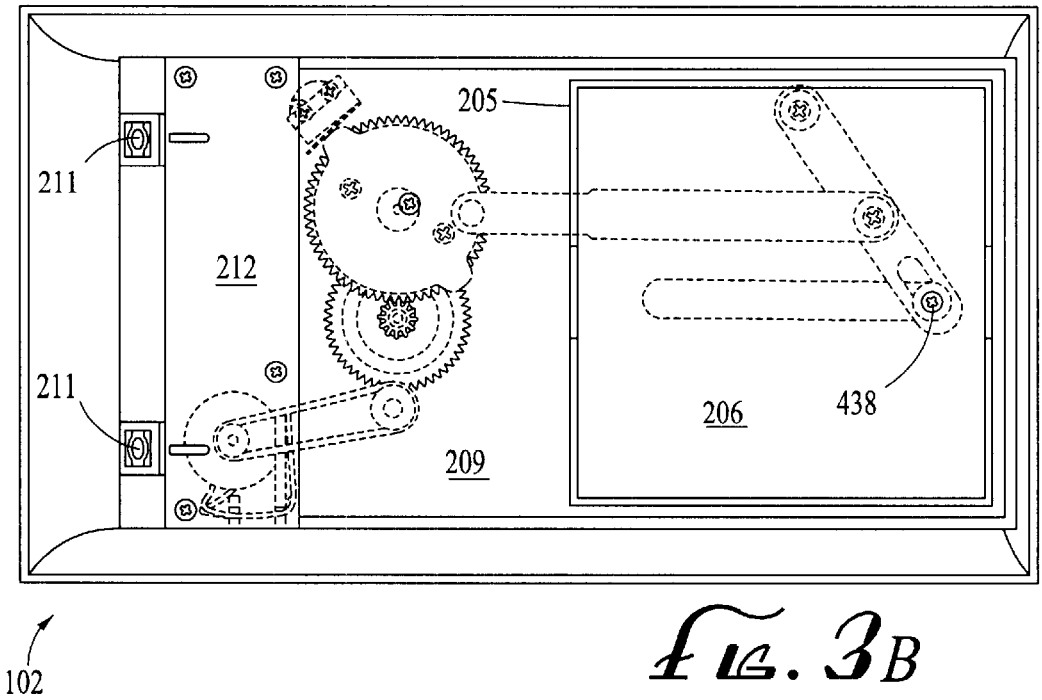
FIG. 3*b* is a plan view of the internal side of the top of the base of the preferred embodiment.

Referring to FIG. 3*a*, a plan view of the internal side of the lid structure of the preferred embodiment is illustrated. From this view, the push bar mechanism, guiding means and guide output 104 are visible. The push bar mechanism of the preferred embodiment is comprised of push bar 103 and the hinge assemblies 318 that pivotably attach the push bar 103 to the lid 101. The posts 319 are positioned and sized to engage the push button switches 211 when the push bar 103 is depressed. The spring 320, which is affixed to the lid 101 by means of rivet 321, returns the push bar 103 to its initial position flush with the exterior of the lid 101 after it is depressed and released. The distal end 322 of the push bar 103 includes a lip that engages the lid 101 to prevent the push bar 103 from pivoting beyond its undepressed position flush with the lid 101. The plan view of the top of the base 102 shown in FIG. 3*b* is included to illustrate the alignment of the carriage 205 with the guide output 104 as well as the push bar 103 and the button switches 211.

The guiding means in the preferred embodiment is comprised of a forward guide 316 and a rear guide 317 that cooperate with the carriage 205 to hold and channel individual sheets to and out of the guide output 104. In this embodiment, the guides 316 and 317 are substantially planar structures that converge to create a tapered opening that is widest at the guide input. The static and kinetic coefficients of the material from which the guiding means is constructed should be relatively low to facilitate the sliding of the individual sheet to the guide output 104. One skilled in the art will recognize that the tapered relationship between the guides 316 and 317 is not strictly necessary and is but one of many means for laterally supporting and directing an uppermost sheet in its upward migration to the guide output 104 as the carriage 205 is driven between the two rest positions. The guides 316 and 317 are supported by means of the mounting plate 315 and screws (not shown) that engage the lid 101, for example.

Figure 4A:
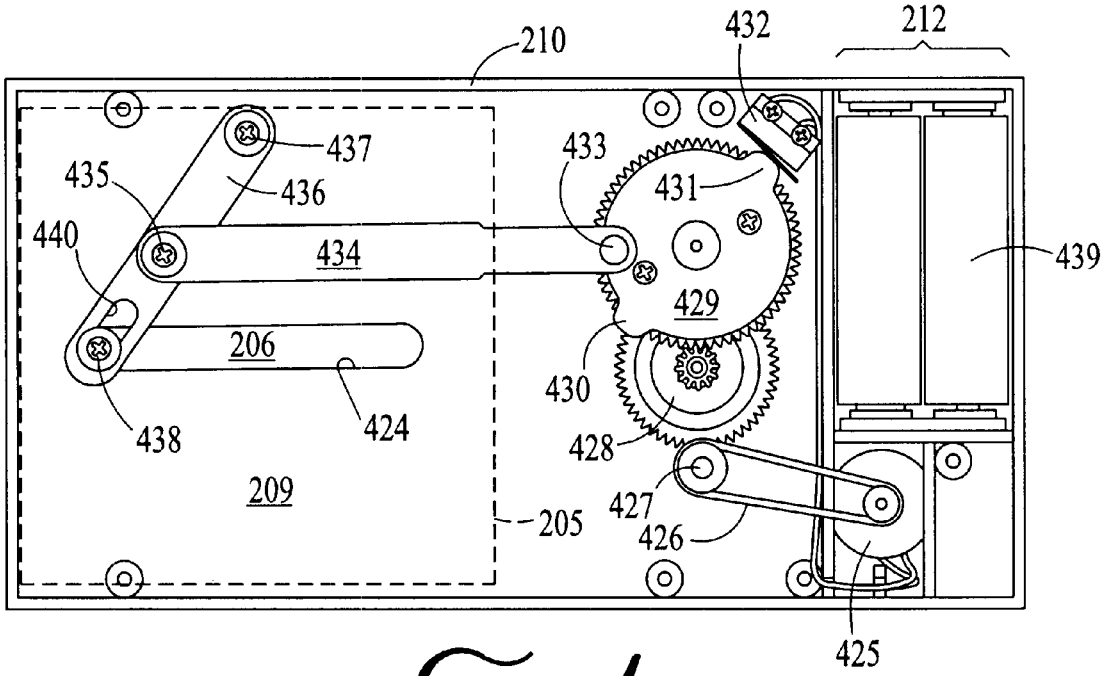
FIG. 4*a* is a plan view of the internal side of the bottom of the base of the preferred embodiment with the carriage in the first rest position.

Referring to FIG. 4*a*, a plan view of the internal side of the bottom of the base of the preferred embodiment is illustrated with the carriage in the first rest position. In this view, the reciprocating means, the flange 210 as well as the underside of the support 209 and internal housing 212 are visible. The support 209 includes the access 424 through which the reciprocating means engages the carriage bottom 206 and repositions the carriage 205. The housing 212 in this embodiment houses the battery 439 and portions of the reciprocating means.

The function of the reciprocating means is to drive, or otherwise reposition, the carriage 205 between the first and second rest positions in response to a user prompting. The effect of repositioning the carriage 205 is to force an individual sheet from the stack up the guiding means and through the guide output 104. In preferred embodiment, the reciprocating means is comprised.of an electric motor 425, belt 426, gears 427 through 429, drive rod 434, swing arm 436, interrupt switch 432 and corresponding electrical circuitry for intermittently powering the motor 425.

Equivalent means for reciprocating the stack of adhesive coated sheets may include manual, electro-mechanical, pneumatic, or hydraulic devices for providing the force to reposition the stack with respect to the guiding means.

The user initiates the dispensation of a sheet by causing the push button 211 to be depressed, which in turn engages the motor 425 and actuates the carriage 205. The turning of the motor 425, coupled to the first gear 427 by means of the belt 426, causes rotation of the series of step-down gears including the first gear 427, second gear 428 and third gear 429. The third gear 429 rotates until either the first or second cam 430 or 431 engages the interrupt switch 432. When depressed, the interrupt switch 432 severs electrical communication between the motor 425 and the battery 439, causing the motor 425 to stop.

As the third gear 429 rotates, the carriage pin 438 is made to reciprocate to and fro within the access 424. More specifically, the drive rod 434 is pivotally engaged to the third gear 429 and is linearly displaced in response to its rotation. The drive rod 434 is pivotally engaged to the swing arm 436 which is, in turn, anchored to the support 209 by means of anchor pin 437. On the opposite end of the swing arm 436 is the pin 438, which is anchor to the carriage bottom 206 and slidably engaged to the slot 440 of the swing arm 436.

Figure 4B:
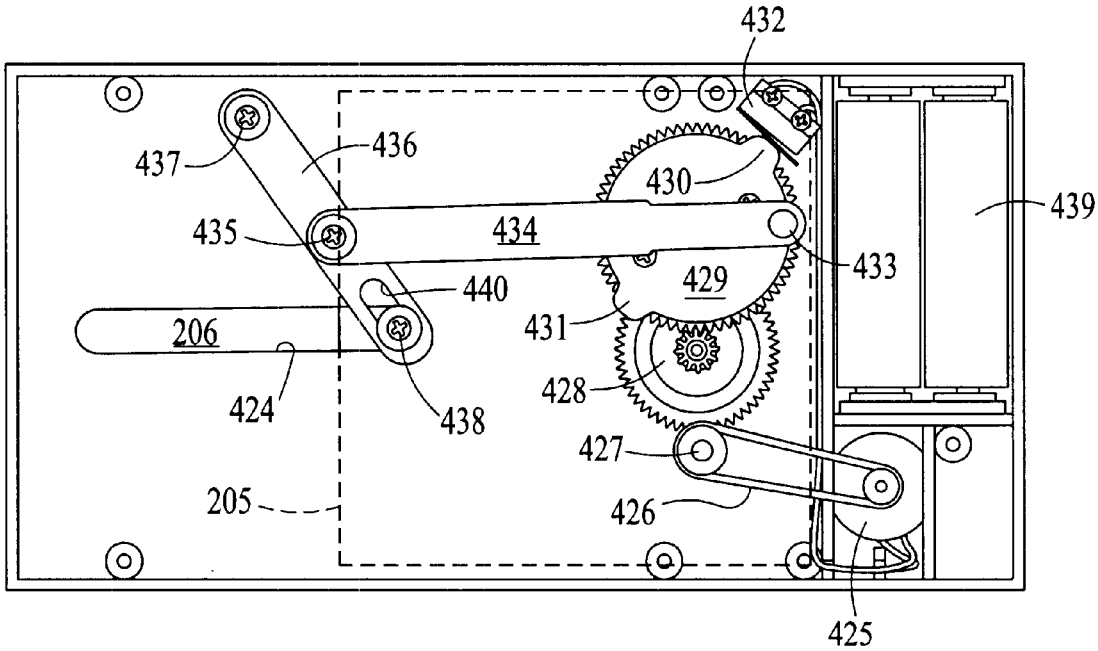
FIG. 4*b* is a plan view of the internal side of the bottom of the base of the preferred embodiment with the carriage in the second rest position.

Referring to FIG. 4*b*, a plan view of the internal side of the bottom of the base of the preferred embodiment is illustrated with the carriage in the second rest position. The location of the interrupt switch 432 and the first and second cams 430 and 431 are positioned on the third gear 429 such that gear 429 rotates approximately 180 degrees with each activation of the push bar 103. Further, the angular position of the pivot 433 on the third gear 429 is such that the pivot 438 stops at one of the two ends of the access 424. In this embodiment, the leftmost point of the pivot 438 corresponds to the first rest positions of the carriage 205 while the rightmost point of the pivot 438 corresponds to the second rest positions of the carriage 205. The throw of the reciprocating means is defined by the radial position of the pivot 433, with respect to the center of the third gear 429. In the preferred embodiment, the throw is equal to half the distance between the carriage's first and second rest positions.

Figure 5:
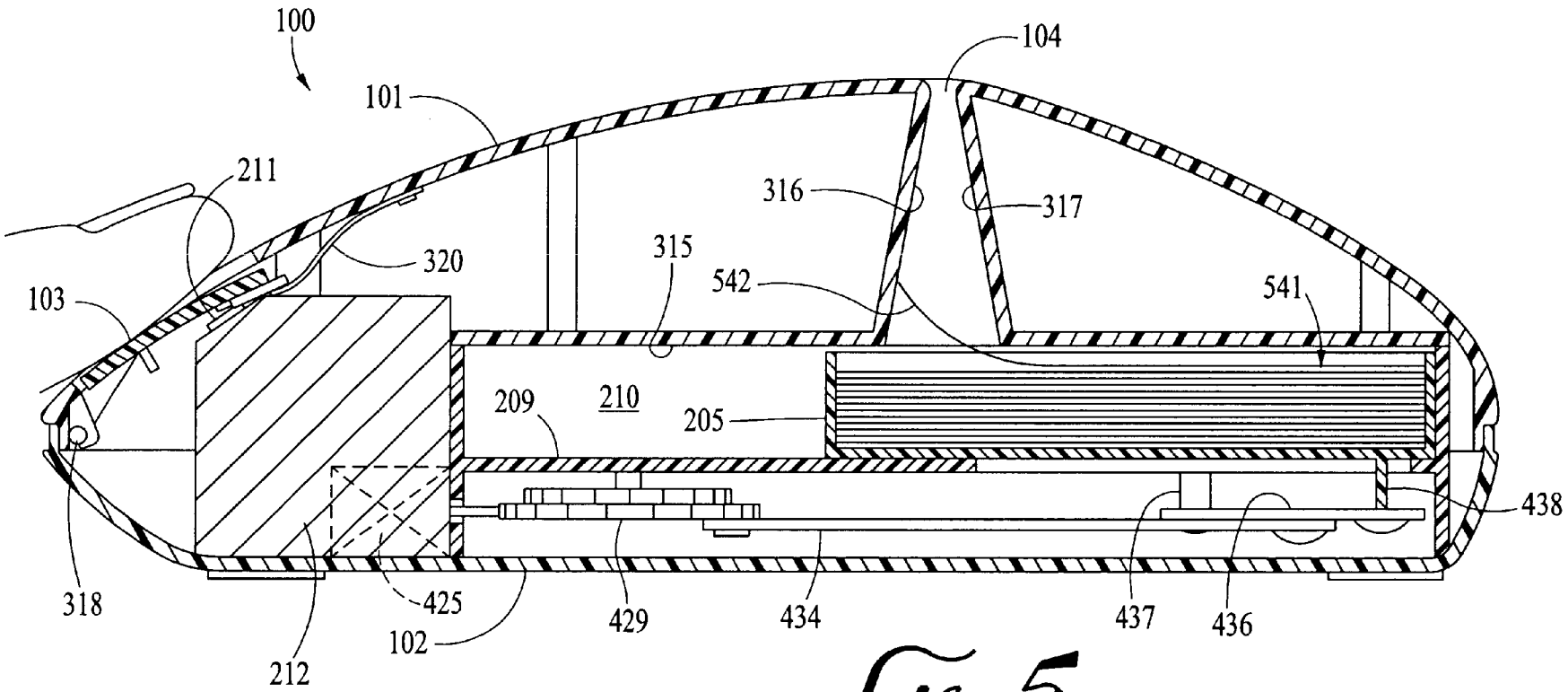
FIG. 5 is a longitudinal cross section through the preferred embodiment of the dispenser with the carriage in the first rest position.

Referring to FIG. 5, a longitudinal cross section through the preferred embodiment of the dispenser with the carriage in the first rest position is illustrated. The carriage 205 includes a stack of adhesive coated sheets 541 and an uppermost sheet 542 which is laterally supported by the forward guide 316. In this embodiment, the uppermost sheet 542 does not protrude beyond the guide output 104 until after the push bar 103 is engaged and the carriage 104 is made to reciprocate. The position of the uppermost sheet 542 against a guide 316 (or against 317 when the carriage 205 is in the second rest position) as illustrated depicts the relative position of the uppermost sheet 542 with respect to the guiding means (1) after the stack has been loaded and (2) after the carriage 205 is reciprocated to the first rest position and the prior uppermost sheet removed.

Figure 6:
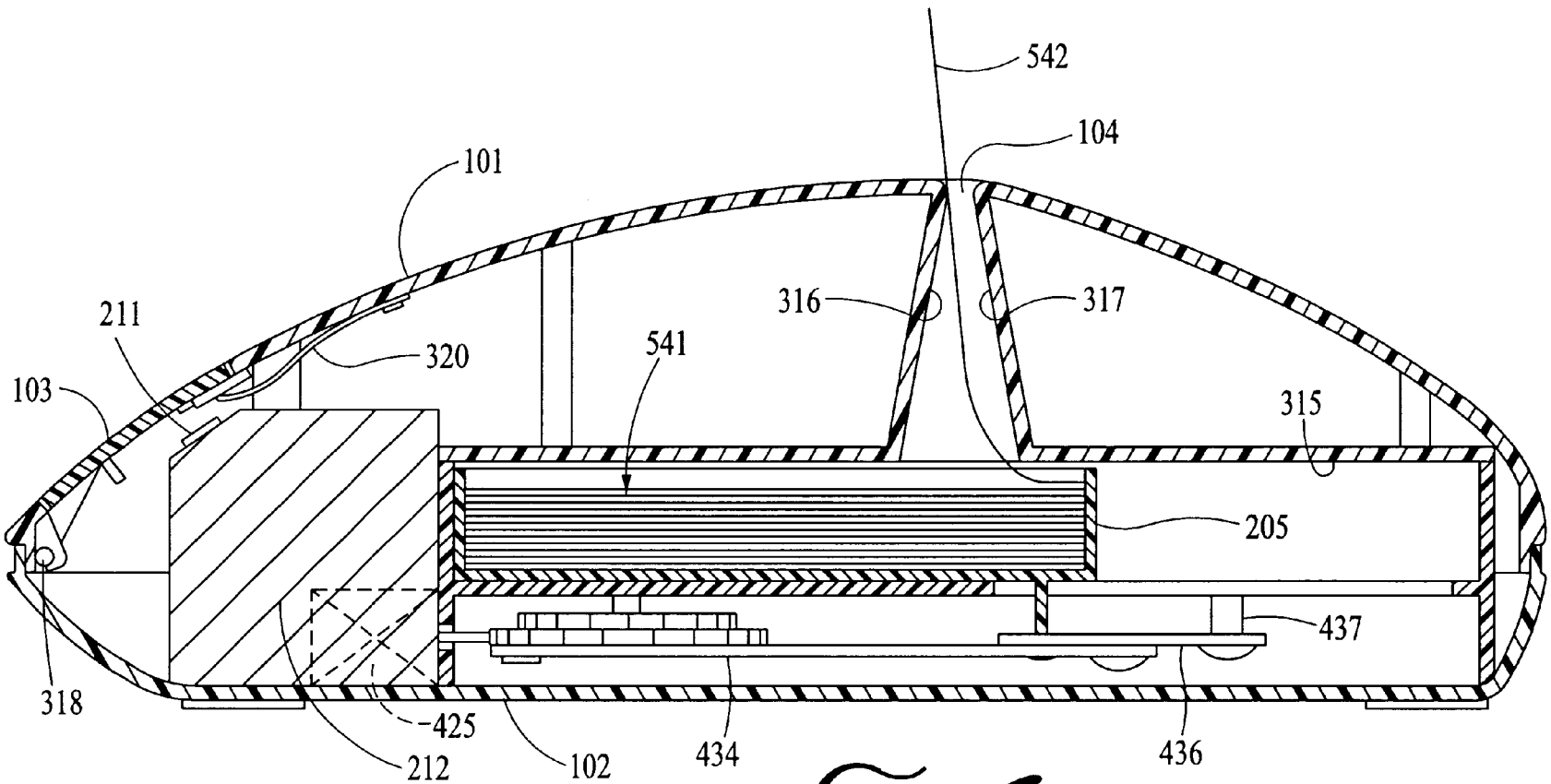
FIG. 6 is a longitudinal cross section through the preferred embodiment of the dispenser with the carriage in the second rest position.

Referring to FIG. 6, a longitudinal cross section through the preferred embodiment of the dispenser with the carriage in the second rest position is illustrated. Here, the carriage 205 has advanced to the second rest position in response to the depression of the push bar 103. The movement of the carriage 205 causes the distal end of the upper most sheet 542 to be driven up to and out of the guide output 104 where it is accessible to the user.

Figure 7:
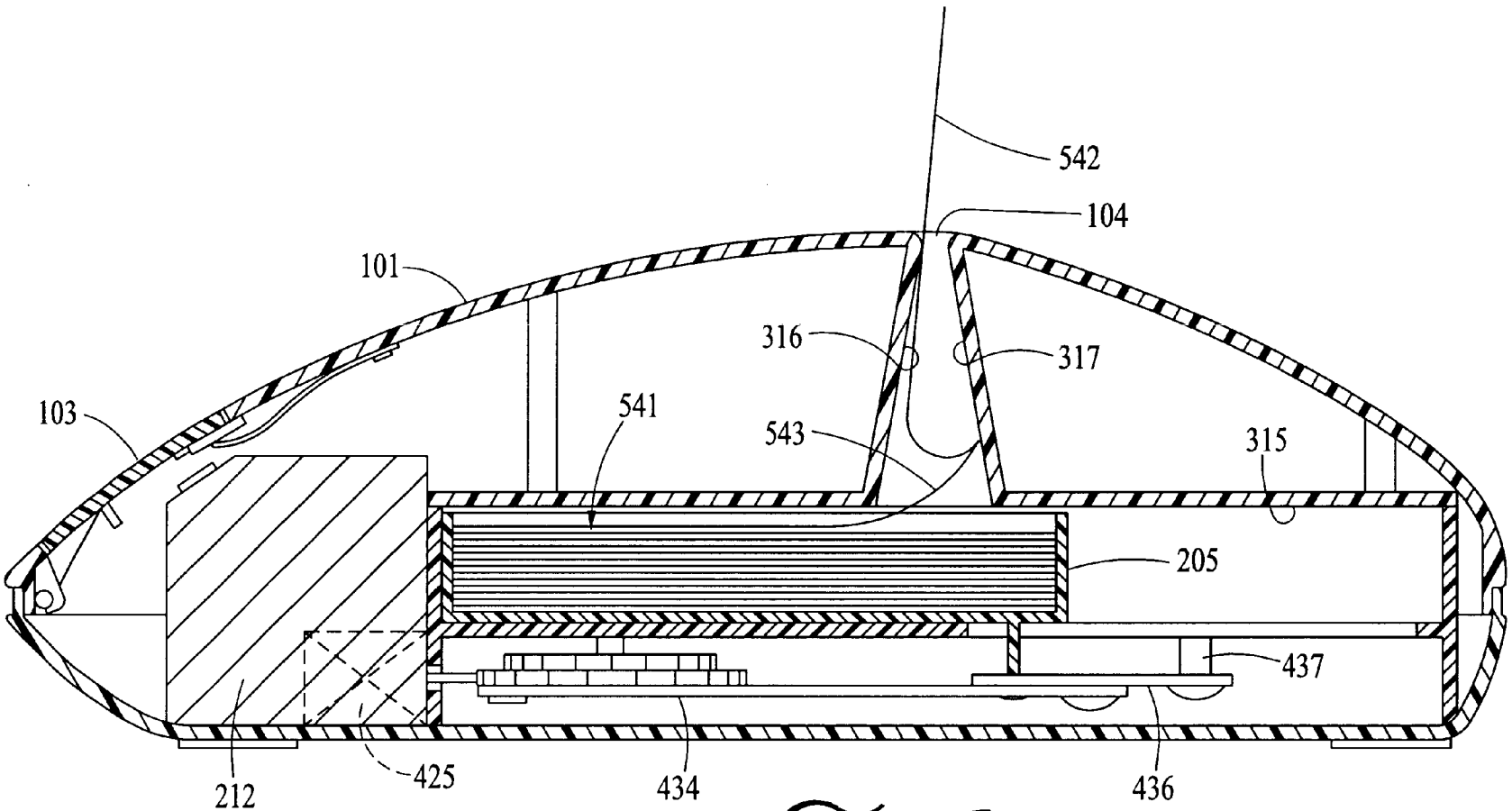
FIG. 7 a longitudinal cross section through the preferred embodiment of the dispenser with the uppermost sheet being removed from carriage.

Referring to FIG. 7, a longitudinal cross section through the preferred embodiment of the dispenser with the uppermost sheet being removed from carriage is illustrated. When the uppermost sheet 542 is removed, the underlying adhesive strip at the proximal end of sheet 542 causes the distal end of the next sheet 543 below to be drawn up into the guide input. Before the next sheet 543 is drawn from the guide output, the adhesive bond between sheets 542 and 543 gives way and the next sheet 543 below remains releasably attached to the stack 541 where it is laterally supported by the rear guide 317. As before, the next most sheet 543 ascends to the position of the uppermost sheet and does not protrude beyond the guide output 104 until after the push bar 103 is engaged and the carriage 104 is made to reciprocate back to the first rest position.

The relative positioning between the guiding means and the stack 541, preferably located in the carriage 205, is important to the operation of the present invention. According to this embodiment specifically, the distance between the guiding means and the stack 541 positioned in the carriage 205 is sufficiently large that the distal end of the uppermost sheet 542 is below or substantially flush with the guide output 104 in one rest position, while the distance must be sufficiently short that the distal end of the uppermost sheet 542 may ascend above the guide output 104 when the carriage 205 is drive to the opposite rest position.

In the case of the 3 inch square adhesive coated paper dispenser of the preferred embodiment, the guiding means is centrally position between the between the first and second rest position about which the carriage 205 oscillates. The lateral displacement of the carriage 205 as it reciprocates between the first and second rest positions is approximately 2 inches. The distance between the guide output 104 and the bottom of the carriage 205 is approximately 2 inches. The distance between the guide input and guide output 104 is approximately 1.4 inches. The angle of the angle the forward and rear guide 316 and 317 with respect to the horizontal is approximately arccos (0.6/3.5). One skilled in the art will recognize that these parameters are subject to variation without frustrating the functionality of the invention.

One skilled in the art will recognize that the invention may take the form of various embodiments different than that described above. For example, the relative positions of the guiding means and stack 541 may be achieved by reciprocating the guide means relative to the stack 541, or by moving both simultaneously. In embodiments in which the guiding means is reciprocated, reciprocating means engages the guiding means while the stack 541 remains static.

The method of dispensing the uppermost sheet 542 of a stack 541 from the dispenser 100 is comprised of the steps of positioning the distal end of the uppermost sheet 542 against the forward guide 316, for example; repositioning the carriage 205 and stack 541 to the second rest position, for example, such that the distal end of the uppermost sheet 542 is dispensed from the guide output 104 where it is accessible to the dispenser's user; positioning the distal end of the next sheet, i.e. the sheet adjacent to the uppermost sheet, against the rear guide 617, for example; and repositioning the stack 541 to the first rest position such that the distal end of an next most sheet is dispensed from the guide output 104 where it is accessible to the dispenser's user. In each of the various embodiments of this method, the step of positioning the distal end of the next sheet, as described above, is achieved by supporting the distal end of the next sheet with the guiding means in such a way as to permit the relative movement of the stack 541 to cause the sheet to be dispensed. In this manner, the underlying sheets of the stack can be ejected from the guide output without necessarily relying on the releasable adhesive bond between the uppermost sheet and next sheet below to draw sheets through the guide output 104.

Although the above description contains many specifics, these should not be construed as limiting the scope of the invention, but rather as merely providing illustrations of some of the presently preferred embodiments of this invention. Therefore, the invention has been disclosed by way of example and not limitation, and reference should be made to the following claims to determine the scope of the present invention.

I claim:

1. An apparatus for dispensing sheets from a stack of adhesive coated sheets; each sheet including a proximal edge, a distal edge, and an adhesive strip; the adhesive strip being on opposite edges of successive sheets of the stack; the apparatus comprising:

(a) a guide output;

(b) guiding means for directing the distal edge of an uppermost sheet to the guide output; and (c) repositioning means for intermittently altering the relative position of the stack and guiding means;

whereby the distal edge of the uppermost sheet is driven from the guiding means to the guide output.

2. An apparatus for dispensing sheets from a stack of adhesive coated sheets; each sheet including a proximal edge, a distal edge, and an adhesive strip; the adhesive strip being on opposite edges of successive sheets of the stack, the apparatus comprising:

(a) a carriage for holding the stack of adhesive coated sheets to be dispensed by the apparatus;

(b) guiding means for:

(i) laterally supporting the distal edge of a sheet, and (ii) directing the distal edge of the sheet out of the guiding means; and (c) reciprocating means for intermittently altering the relative position of the carriage and guiding means;

whereby the distal edge of the sheet being laterally supported by the guiding means is directed out of the guiding means in response to the relative repositioning of the carriage and guiding means.

3. The apparatus in claim 2, wherein the guiding means is comprised of a forward guide and a rear guide.

4. The apparatus in claim 3, wherein the forward guide and rear guide are substantially planar structures that converge at a guide output.

5. The apparatus in claim 4, wherein the reciprocating means reciprocates the carriage, relative to the guiding means, between first and second rest positions.

6. The apparatus in claim 5, wherein apparatus further includes an input device for actuating the reciprocating means.

7. An apparatus for dispensing sheets from a stack of adhesive coated sheets; each sheet including a proximal edge and a distal edge; the apparatus comprising:

(a) a carriage for receiving the stack of adhesive coated sheets to be dispensed by the apparatus;

(b) reciprocating means for intermittently driving the carriage from a first rest position to a second rest position and vice versa; and (c) guiding means, comprising a guide input and guide output, for directing the distal edge of a sheet from the guide input to the guide output as the carriage is driven by the reciprocating means from the first rest position to the second rest position or vice versa.

8. The apparatus of claim 7, wherein the first and second rest positions are symmetrically disposed on either side of the guide input.

9. The apparatus of claim 8, wherein the minimum distance between the guide output and the stack of adhesive coated sheets in the carriage is less than the length of the sheet such that the sheet may be made to protrude from the guide output.

10. The apparatus of claim 9, wherein the guiding means is comprised of a forward guide and a rear guide made of low friction material.

11. The apparatus of claim 10, wherein the forward and rear guides are substantially planner structures that are convergent and form the guide output.

12. The apparatus of claim 11, wherein the forward and rear guides define an interior angle less than 30 degrees.

13. The apparatus of claim 7, wherein the reciprocating means includes a solenoid for driving the carriage.

14. The apparatus of claim 7, wherein the reciprocating means includes a motor for driving the carriage.

15. The apparatus of claim 7, wherein the apparatus further includes an input device for actuating the reciprocating means.

16. The apparatus of claim 15, wherein the input device is comprised of a push bar.

17. A method of dispensing sheets from a stack of adhesive coated sheets located at a first rest position, the method comprising the steps of:

(a) positioning the distal end of an uppermost sheet against a first guide of a guiding means;

(b) repositioning the stack of adhesive coated sheets to a second rest position such that the distal end of an uppermost sheet is dispensed from a guide output of the guiding means where it is accessible to a dispenser user;

(c) positioning the distal end of a next most sheet against a second guide of the guiding means; and (d) repositioning the stack of adhesive coated sheets to the first rest position such that the distal end of the next most sheet is dispensed from the guide output of the guiding means where it is accessible to the dispenser user;

whereby the distal end of the next most sheet is dispensed independent of the removal of the uppermost sheet by the user.

18. The method in claim 17, wherein the first and second guides are substantially planar structures that converge to the guide output.

19. The method of claim 18, wherein the repositioning of the stack of adhesive coated sheets is achieved by a carriage and reciprocating means.

20. The method of claim 19, wherein the carriage intermittently reciprocates between the first and second rest positions.

21. The method of claim 20, wherein the carriage is made to intermittently reciprocating by the reciprocating means in response to user input.

22. The method of claim 21, wherein the reciprocating means is comprised of an electric motor.

23. The method of claim 21, wherein the reciprocating means is comprised of a solenoid.

24. The method of claim 21, wherein the reciprocating means is manually actuated.

* * * * *